United States Patent [19]

Bienus et al.

[11] 4,444,586

[45] Apr. 24, 1984

[54] METHOD OF MELTING COPPER IN A HEARTH MELT-DOWN FURNACE WITH ROOF BURNER SYSTEM

[75] Inventors: John S. Bienus, Englishtown; Konstantin G. Theofilos, So. Plainfield; John N. Carris, Mountainside; Ernest M. DeLeo, Parlin, all of N.J.

[73] Assignee: AMAX Inc., Greenwich, Conn.

[21] Appl. No.: 445,870

[22] Filed: Dec. 1, 1982

[51] Int. Cl.[3] ..... C22B 15/04

[52] U.S. Cl. ..... 75/65 R; 75/72; 75/76; 266/214; 266/900

[58] Field of Search ..... 75/65 R, 76, 72; 266/214, 900, 901

[56] References Cited

U.S. PATENT DOCUMENTS

| | | | |
|---|---|---|---|
| 1,756,967 | 5/1930 | Alexander | 75/76 |
| 1,914,717 | 6/1933 | Hever | 266/214 |
| 1,965,928 | 7/1934 | McGregor | 75/65 R |
| 3,129,930 | 4/1964 | Labat-Camy | 266/214 |
| 3,734,719 | 5/1973 | Estes et al. | 75/65 R |
| 4,200,265 | 4/1980 | Berndt et al. | 266/901 |

*Primary Examiner*—M. J. Andrews

*Attorney, Agent, or Firm*—Michael A. Ciomek; Eugene J. Kalil

[57] ABSTRACT

Copper is melted in a reverberatory furnace having a longitudinally extending hearth, a roof, side and end walls and having a burner system at one end wall thereof for providing at least one flame extending longitudinally through said furnace for heating the hearth thereof, the method also including using at least one oxygen lance extending downwardly from the roof of the furnace with the flame thereof in head-on contact with a unit portion of copper charged to the furnace, the total charge in the furnace comprising a plurality of unit portions disposed along said hearth.

5 Claims, 5 Drawing Figures

METHOD OF MELTING COPPER IN A HEARTH MELT-DOWN FURNACE WITH ROOF BURNER SYSTEM

This invention relates to a method of melting copper in a hearth furnace and, in particular, to an improved method for melting copper in a reverberatory furnace.

STATE OF THE ART

It is known to fire refine blister copper in reverberatory or anode furnaces preliminary to the electrolytic refining thereof. The copper should be fire refined to the highest degree economically possible in order to provide a uniform high-grade product to send to the electrolytic refining process. The bulk of the impurities is removed in the anode furnace while the remainder is removed during electrolytic refining.

Fire refining is comprised of a series of operational steps which include oxidation, fluxing and reduction in order to remove readily oxidizable impurities. The reverberatory furnace is comprised of a longitudinally extending hearth, a roof, side and end walls and has a burner system at one end wall thereof to provide one or more flames extending substantially horizontally and longitudinally through the furnace for heating the hearth thereof.

A typical reverberatory furnace may range in width from about 12 to 16 feet and in length from about 35 to 50 feet, with a holding capacity of about 200 to 400 tons or 450 tons.

The reverberatory furnace may be fired with oil, gas or pulverized fuel, oil being generally preferred. A furnace 15 feet wide and 50 feet long and having a capacity in the neighborhood of about 425 to 450 tons generally requires a total refining time of charge to charge of about 32 to 34 hours. The furnace is charged with copper through side doors, the charge consisting essentially of blister cake, with or without scrap or "secondaries". The impurities in the molten copper are oxidized which is taken up by fluxes to form a slag which is later skimmed off, some of the impurities also being removed by volatization. As the copper is ultimately oxidized it is later reduced by poling.

In summary, the various operations comprise charging, melting, oxidizing, poling and casting, the total time as stated hereinabove for a particular reverberatory furnace (15 feet wide by 50 feet long) ranging from about 32 to 34 hours.

With regard to the refining of blister copper, attention is directed to Vol. II of the Handbook of Non-Ferrous Metallurgy dated 1926 edited by Donald M. Liddell (McGraw-Hill Book Company, Inc.), pages 957 to 965, the contents of which are incorporated herein by reference.

With the rise in fuel prices the cost for fire-refining has increased substantially. It would be desirable to provide an improved fire-refining process which is less costly and more efficient.

OBJECTS OF THE INVENTION

It is thus an object of the invention to provide an improved process for the fire-refining of metallic copper.

Another object is to provide a process to refine copper more efficiently, e.g., blister copper, in a reverberatory furnace.

These and other objects will more clearly appear when taken in conjunction with the following disclosure, claims and the drawings, wherein:

We have found that the total time for refining copper can be greatly reduced, and with it the cost per ton, by employing in addition to the end burner, one or more vertically disposed roof burners of the oxygen lance type. We have further found that by employing the improved system, the roof during fire refining is unexpectedly cooler such that furnace life is increased, thus saving on furnace maintenance cost as will be clearly apparent from the following description of the invention.

STATEMENT OF THE INVENTION

Stating it broadly, the invention is directed to a method for melting copper in a reverberatory furnace comprised of a longitudinally extending hearth, a roof, side and end walls, and normally having a burner system at one end wall thereof to provide one or more flames extending longitudinally through said furnace for heating the hearth thereof and wherein metallic copper is charged to said furnace in the form of a plurality of unit portions disposed along the hearth starting at the burner end.

The improvement resides in melting the charge of copper by additionally using at least one oxygen lance extending downwardly from the roof of said furnace with the flame thereof in head-on contact with a corresponding unit portion of said copper located below the oxygen lance, and continuing the melting of the copper using the oxygen lance, whereby the total time in the furnace starting with the charging of said copper to the complete melting, refining treatment, and casting thereof is greatly reduced, as compared to the melting of substantially the same weight of the copper using the end burner system alone. By using the improved method, the efficiency of the furnace is markedly improved in terms of total fuel consumption per ton of copper processed, in terms of increased production rate and in terms of increased furnace life.

A portion of the copper fed to the furnace may be in a molten state so long as the solid portion of the charge is at least about 70% of the total charge.

Figure 1:
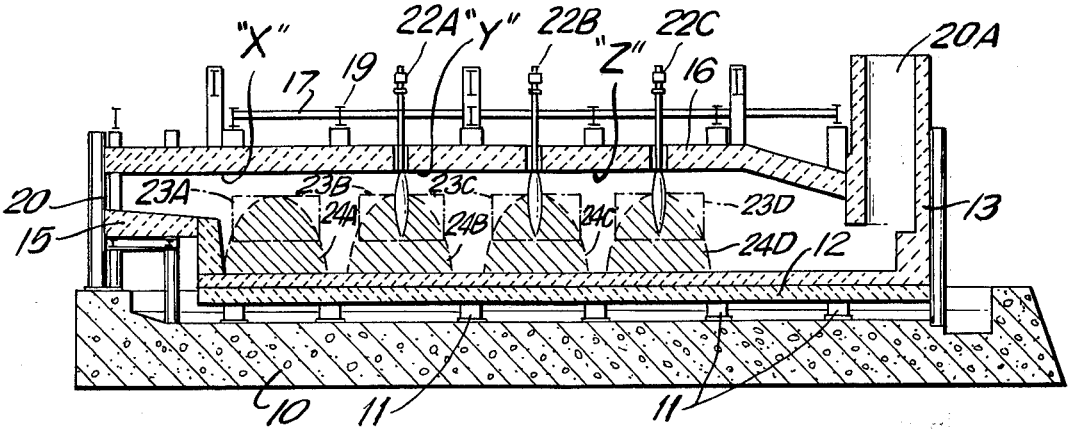
FIG. 1 is a longitudinal section of a reverberatory furnace normally employed in the fire-refining of blister copper.
Figure 2:
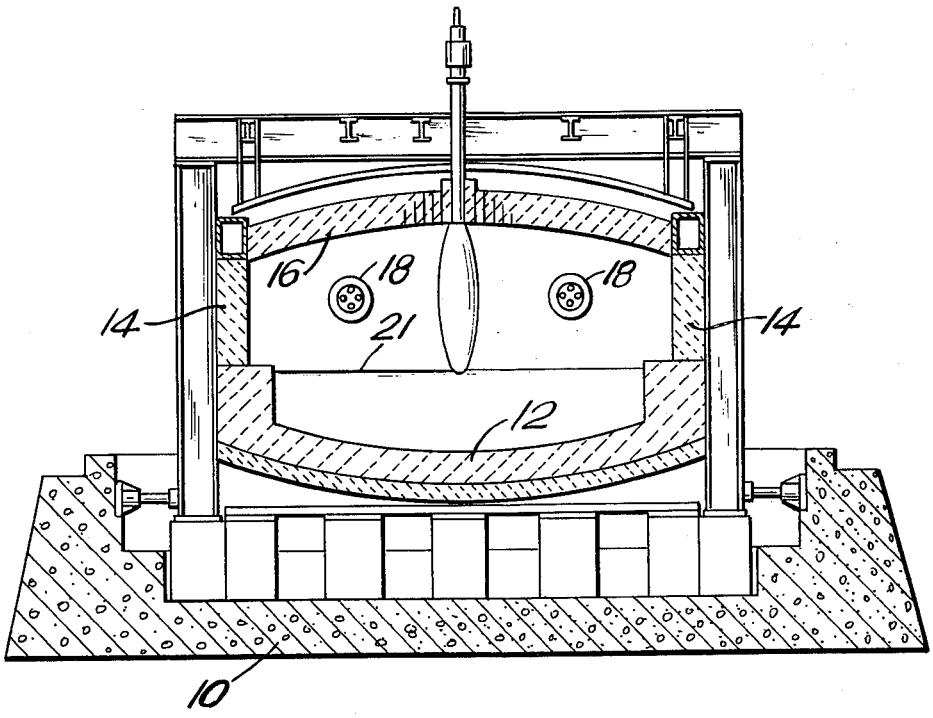
FIG. 2 is an enlarged cross section of the furnace shown in FIG. 1.

As illustrative of one embodiment of a reverberatory furnace employed in carrying out the furnace, reference is made to the schematic of FIGS. 1 and 2, FIG. 1 being a typical longitudinal section of the furnace, while FIG. 2 is a cross section thereof looking towards the conventional end burners.

The furnace (FIG. 1) is supported on a concrete bed or pedestal 10 with spaced cross-supports 11 for supporting the furnace bottom 12, generally of chrome-magnesite composition (see also FIG. 2). Depending on the slag line, the end and side walls 13, 14 may also comprise chrome-magnesite refractory, including the bridge 15 shown at the burner end. The upper side walls (FIG. 2) may be either burned chrome-magnesite or metal encased magnesite-chrome to resist dust laden gases and the splashing and working action which occurs during flapping and poling of the charge.

The roof 16 is of suspended construction and may be silica brick. More conventionally, the roof is basic. Suspension supports for the roof are shown schematically in FIG. 1 comprising an array of I-beams 17, 19 by means of which the roof is hung. The conventional burner 18 (FIG. 2) is at one end 20 of the furnace, the flue 20A for the gases being at the opposite end.

Referring to FIG. 2, the bath or slag line is indicated by numeral 21. Because corrosion of the walls particularly occurs at the slag line, direct bonded bricks are widely used, although other types may be employed, such as fused cast sections, rebonded fused cast structures and the like.

Regardless of the structure or refractory composition employed, we have found that with our novel process the life of the furnace is markedly improved and less maintenance is required.

In a preferred embodiment, such as that shown in FIG. 1, three spaced oxygen lances 22A, 22B and 22C are employed which extend through the roof with the flames thereof making head-on contact with a corresponding unit portion of copper located below each of the lances. The unit portions are charged sequentially into the furnace using hydraulically operable loading means which charge the copper into the furnace via door openings 23A, 23B, 23C and 23D, the portions of copper loaded into the furnace being designated by numerals 24A to 24D. The three lances need not all be used. For example, lances 22A and 22B may be used and lance 22C omitted. Or lances 22B and 22C may be used to the exclusion of 22A.

Whatever combination of lances are employed, we have found that improved results are obtained as evidenced by accelerated melting time and the concomitant advantage of less fuel per ton of copper melted.

We noted surprisingly that while the oxygen lance is characterized by a flame of very high temperature, the roof temperature does not increase but, on the contrary, decreases. We believe that this is due to the fact that when the flame from the oxygen lance strikes the top of the unit copper charge the heat immediately penetrates the copper due to its very high heat conductivity and a pool of metal immediately forms within the unit charge of copper. Thus, the heat is used up efficiently and less heat is bounced back to the roof, in that the flame is not deflected upward towards the roof to the same extent as occurs when the conventional horizontal burner is used alone.

Thus, by relying to a large measure on the roof burners, one can cut back on the amount of fuel burned by the horizontal burners. A still further advantage of the roof burners is that the atmosphere within the furnace is cleaner and much less smoky than when the horizontal burners are employed.

Figure 3:
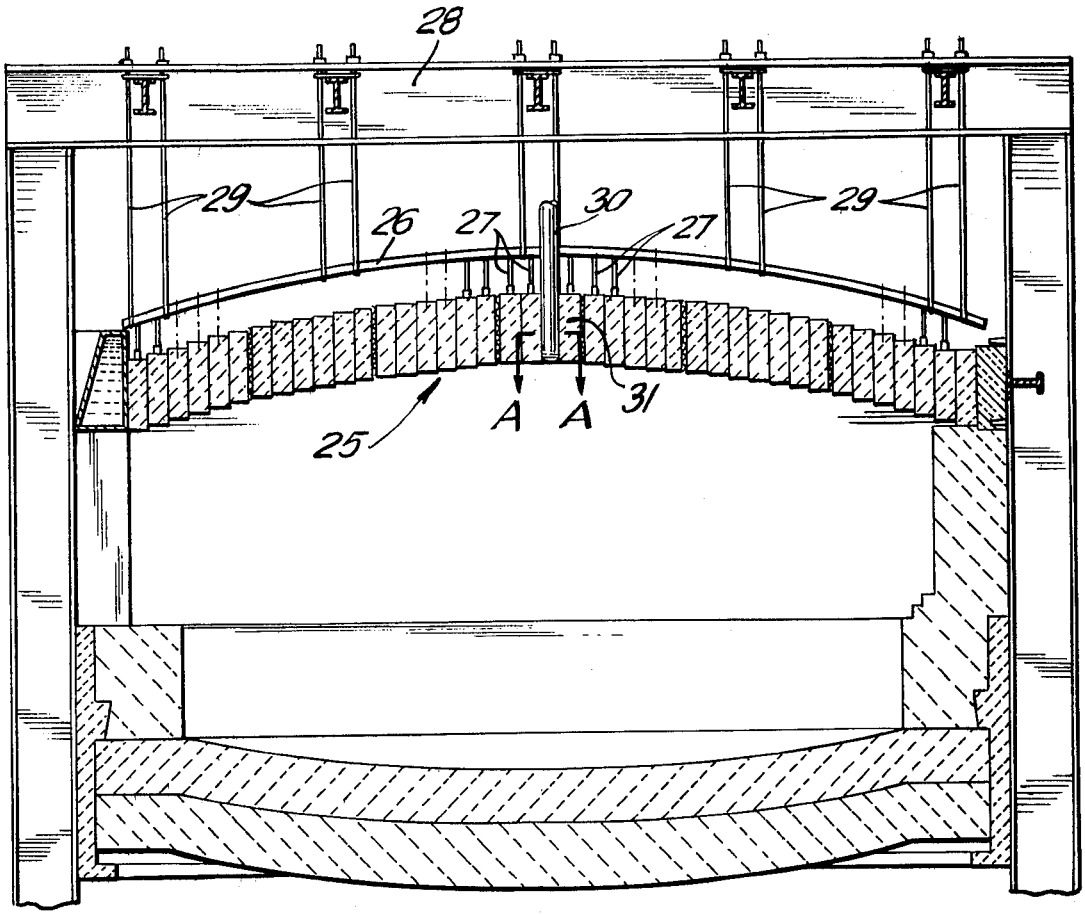
FIG. 3 is a more detailed cross section of the reverberatory furnace.

A more detailed rendition of the cross section of the reverberatory furnace is shown in FIG. 3. The roof which is designated generally by the numeral 25 is shown suspended from roof support means 26 by support rods 27, the roof support being in turn attached to the furnace superstructure 28 (I-beams) via connecting means 29.

Figure 4:
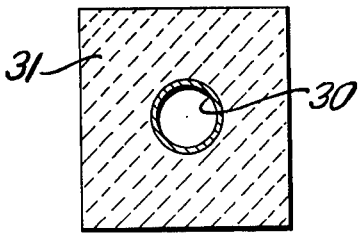
FIG. 4 is an enlarged cross section taken along line A—A of FIG. 3 showing the burner holding block through which the oxygen lance passes.

Tubular portion or casing 30 of the roof burner is shown passing through burner block 31 of a special crack-resistant refractory comprising about 93.7% $Al_2O_3$, about 5.4% CaO as a binder and the balance less than 1% total of $SiO_2$, $Fe_2O_3$, $TiO_2$ and MgO. This burner-support block is important and should have a life commensurate with the furnace life. Thus, the support block is preferably an alumina brick, that is, a brick which is predominantly alumina. A cross section of the burner block 31 is shown in FIG. 4.

The oxygen lance employed for the roof burner is well known in the art. The lance is water-cooled and has a central axis bore for oil and an annular passage surrounding it for oxygen flow, whereby the two streams merge at the exit end such that the oil leaving the nozzle downstream is atomized by and uniformly mixed with the oxygen exiting the lance adjacent the oil nozzle.

Figure 5:
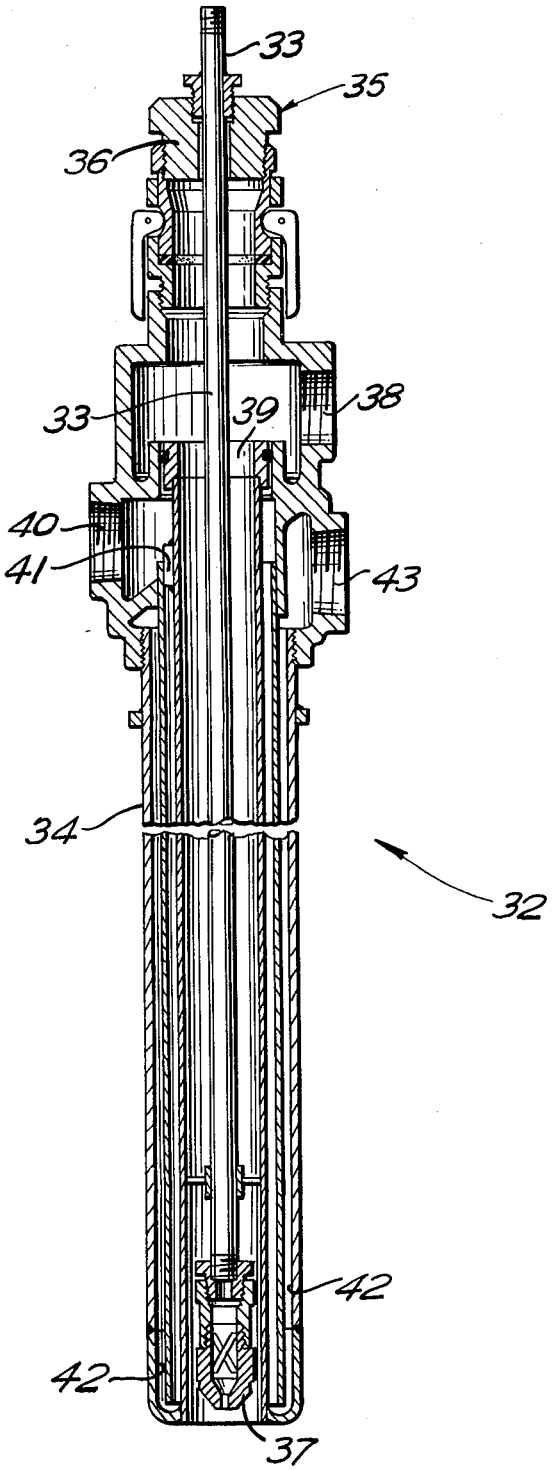
FIG. 5 is a cross section of a typical oxygen lance used as roof burners in carrying out the invention.

A typical oxygen lance is one sold by the Linde Division of Union Carbide and Carbon and which is similar to that illustrated in FIG. 5.

The oxygen lance which is designated generally by the numeral 32 is cylindrical in shape and has a center tube 33 through which fuel oil is fed. The lance is characterized by an outer cylindrical casing 34, one end 35 of the lance having a plug assembly 36 through which oil feed tube or pipe 33 passes to the opposite end of the casing, the terminal portion of the oil feed pipe having an atomizing nozzle 37 coupled thereto through which the oil passes for atomization by the oxygen stream flowing concurrently and concentrically with the oil flow.

The oxygen is fed into opening 38 in the casing which flows longitudinally through the cylindrical lance in annular chamber 39 concentrically surrounding oil feed pipe 33. The lance casing includes a water jacket concentrically surrounding the oil and oxygen chambers, the water being fed into opening 40 in the casing which flows down annular chamber 41 and into outer annular chamber 42, up and out through exit port 43 of the casing.

By using the melting system of the invention, the total time of charging, melting, poling, slag skimming and casting can be reduced from about 32 or 34 hours to as low as about 20 to 22 hours with savings in fuel costs, with increased production rate and increased furnace life.

As illustrative of the invention, the following is given:

EXAMPLE

A test 1A was conducted without the use of the oxygen lance in which a reverberatory furnace about 15 feet wide and about 50 feet long and having a melt capacity of about 430 tons copper was preheated via the conventional end burner prior to charging with copper, the furnace being the type illustrated in FIGS. 1 to 3. Following preheat to a temperature of about 2000° F. (1093° C.), the furnace was charged with a unit portion of blister copper through door 23A and succeeding charges of unit portions through each of door openings 23B, 23C and 23D.

The time for charge and recharging the furnace during initial melt-down to reach a total charge of 430 tons came to about 14.5 hours. Following complete charging of the furnace, it took 4.5 hours to reach complete melt-down. The skimming of the bath took 6.5 hours, while poling took 2 hours. The melt was complete and ready for casting after a total of 27.5 hours. The total net cycle including casting (6 hours) came to 33.5 hours.

The total gallons of oil consumed came to 14,693 or approximately 35 gal./ton. The amount of oil consumed per burner was approximately 225 gal./hr. (or approximately 450 gal./hr. for both burners). The amount of air employed at 3% oxygen enrichment came to about 11,000 cubic feet/hr. or a total of 22,000 cubic feet/hr. for both end burners combined.

Test 1B utilizing three oxygen lances was then conducted in which the furnace as before was preheated using the end burners. Following preheat to a temperture of about 2000° F. (1093° C.), the furnace was charged as in Test 1A with unit portions of copper through each of the doors 23A, 23B, 23C and 23D. In addition to the end burners, all three oxygen lances were ignited, oxygen being employed as the oxidizing gas for the oil.

The time for charge and recharge until 430 tons total had been charged came to the much lower time of 6.5 hours. The complete melt-down took 2.5 hours; skimming took 6.5 hours and poling took 2 hours. The furnace was ready for casting after 17.5 hours with the casting time taking 6 hours, the total net cycle including casting came to 23.5 hours.

The total gallons of oil used by the end burners came to 6,997 gallons and the total oil equivalent used by the three roof burners to about 2,000 gallons.

The total amount of oil consumed per hour for the end burners and the three burners came to about 383 gals./hr. The three roof burners consumed 90,000 cubic feet/hr. of oxygen (maximum 6 hrs.).

Thus, comparing the two runs 1A (end burners only) and 1B (end burners plus the three roof burners) savings were achieved in processing the same weight of copper in terms of decrease of total time, increase in production rate and in decrease of fuel per ton of copper as will clearly appear from the tables below:

TABLE 1

| Test No. | Total Copper Processed | Total Time | Tons Of Copper/Hr. | Gallons Of Fuel/Hr. |
|---|---|---|---|---|
| 1A | 430 tons | 33.5 Hrs. | 12.8 | 35 |
| 1B (Invention) | 430 tons | 23.5 Hrs. | 18.3 | 23 |

TABLE 2

| Test No. | Total Copper Processed | % Decrease In Time | % Increase Rate | % Decrease Fuel/Ton |
|---|---|---|---|---|
| 1A | 430 tons | — | — | — |
| 1B (Invention) | 430 tons | 29.8 | 43 | 34 |

As stated herein, one of the advantages of the invention is the surprising discovery that even when three roof burners are employed together with the conventional end burner, the roof of the furnace contrary to expectation operated at a cooler temperature, despite the fact that the rate of melt-down of the copper increased by over 40%.

Thus, referring to FIG. 1 of the drawing showing the location of the three roof burners, temperature measurements taken at Sections "X", "Y" and "Z" of the roof showed that the roof at these sections was significantly cooler using the invention (Test 1B) as compared to the conventional method (Test 1A) as follows:

TABLE 3

| | Roof Temperature | | |
|---|---|---|---|
| Test No. | Section X | Section Y | Section Z |
| 1B (Invention) | 600° F. | 425° F. | 400° F. |
| 1A (Conventional) | 800° F. | 500° F. | 475° F. |

The temperature differences had a marked beneficial effect on the life of the furnace as was evidenced by the fact that less maintenance was required.

The term "reverberatory furnace" used in the disclosure and claims is understood to cover any hearth furnace having utility in the melting of copper. Thus, while the furnace described is a stationary furnace, it will be understood that the term is meant to include a rocking furnace as well, that is, a furnace capable of rocking or pivoting about its longitudinal axis.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. In a method for melting copper in a reverberatory furnace comprised of a longitudinally extending hearth, a roof, side and end walls, and having a burner system at one end wall thereof to provide at least one flame extending longitudinally through said furnace for heating the hearth thereof and wherein metallic copper is charged to said furnace in the form of a plurality of unit portions disposed along said hearth, the improvement which comprises, charging a plurality of unit portions of metallic copper along said hearth in spaced relationship, melting said charge of copper by additionally using at least two oxygen lances extending downwardly from the roof of said furnace with the flame of each lance in head-on contact with a corresponding unit portion of copper disposed directly below said oxygen lance, and continuing the melting of said charge of copper using said oxygen lances, whereby the time in said furnace starting with the charging of said unit portions of copper to the complete melting, treatment, and casting thereof is greatly reduced, as compared to the melting of the copper using the end burner system alone, and whereby the efficiency of said furnace is markedly improved in terms of less fuel consumed per ton of copper processed, in terms of increased production rate and in terms of increased furnace life as compared to the same furnace using the end burner system alone.

2. The method of claim 1, wherein the plurality of unit portions of the copper charged to said furnace comprise at least three unit portions thereof, and wherein said at least two spaced oxygen lances are cooperably associated with at least two of said at least three unit portions.

3. The method of claim 1, wherein the total charge of copper in the reverberatory furnace comprises four unit portions and wherein each of three of the unit portions are located below a corresponding oxygen lance.

4. In a method for melting copper in a reverberatory furnace comprised of a longitudinally extending hearth, a roof, side and end walls, and having a burner system at one end wall thereof to provide at least one flame extending longitudinally through said furnace for heating the hearth thereof and wherein metallic copper is charged to said furnace in the form of a plurality of unit portions disposed along said hearth, the improvement which comprises, charging at least three unit portions of said copper spaced along said hearth, melting said charge of copper by additionally using at least two oxygen lances extending downwardly from the roof of said furnace with the flame of each of said lances in head-on contact with a corresponding unit portion of said at least three unit portions of copper disposed directly below said oxygen lance, and continuing the melting of said charge of copper including additional amounts of copper charged to the furnace during melting using said oxygen lances, whereby the time in said furnace starting with the charging of said copper to the complete melting, treatment, and casting thereof is greatly reduced, as compared to the melting of the same amount of copper using the end burner system, and whereby the efficiency of said furnace is markedly improved in terms of less fuel consumed per ton of copper processed, in terms of increased production rate and in terms of increased furnace life as compared to the furnace using the end burner system alone.

5. The method of claim 4, wherein the total copper charged to said furnace has a total weight ranging from about 200 to 450 tons and comprises four unit portions thereof, and wherein three spaced oxygen lances are employed extending downwardly from the roof of said furnace, with the flame of each of said lances directed in head-on contact with a corresponding unit portion of said copper disposed below each of said lances.

* * * * *